US008171873B2

(12) United States Patent
Woolwright et al.

(10) Patent No.: US 8,171,873 B2
(45) Date of Patent: May 8, 2012

(54) ASSEMBLY FOR DEPLOYING A PAYLOAD FROM A SUBMARINE

(75) Inventors: Michael Woolwright, Bristol (GB); Chris Murphy, Bristol (GB); James Dobbin, Bath (GB)

(73) Assignee: Babcock Integrated Technology Limited, Bristol (GB)

( * ) Notice: Subject to any disclaimer, the term of this patent is extended or adjusted under 35 U.S.C. 154(b) by 801 days.

(21) Appl. No.: 12/089,562

(22) PCT Filed: Oct. 9, 2006

(86) PCT No.: PCT/GB2006/003747

§ 371 (c)(1),
(2), (4) Date: Aug. 8, 2008

(87) PCT Pub. No.: WO2007/042783

PCT Pub. Date: Apr. 19, 2007

(65) Prior Publication Data

US 2009/0126619 A1 May 21, 2009

(30) Foreign Application Priority Data

Oct. 11, 2005 (GB) ..... 0520653.7

(51) Int. Cl.

| | |
|---|---|
| ***B63G 8/41*** | (2006.01) |
| ***B63C 9/02*** | (2006.01) |
| ***B63C 9/22*** | (2006.01) |
| ***B63C 9/23*** | (2006.01) |

(52) U.S. Cl. ..... 114/322; 114/326; 114/365; 441/42

(58) Field of Classification Search ..... 114/322–329, 114/365, 367, 376; 89/1.809, 1.81; 441/40–42
See application file for complete search history.

(56) References Cited

U.S. PATENT DOCUMENTS

| | | | | |
|---|---|---|---|---|
| 1,721,039 | A * | 7/1929 | Risher | 114/324 |
| 1,741,827 | A * | 12/1929 | Cooke | 114/324 |
| 2,355,918 | A * | 8/1944 | Kotelev et al. | 114/316 |
| 2,592,461 | A * | 4/1952 | Perkins et al. | 441/17 |
| 3,499,364 | A * | 3/1970 | D'Ooge | 89/1.81 |

(Continued)

FOREIGN PATENT DOCUMENTS

| | | |
|---|---|---|
| DE | 1176019 | 8/1964 |

(Continued)

OTHER PUBLICATIONS

JP Search Report for Japanese Application No. 2008-535084 with English translation, Sep. 26, 2011, Japanese Patent Office, Japan.

*Primary Examiner* — Ajay Vasudeva
(74) *Attorney, Agent, or Firm* — Stites & Harbison PLLC; Marvin Petry

(57) ABSTRACT

A submarine (1) has an assembly (3) for deploying a life raft (5), the assembly (3) being located in a well (7) formed outside the submarine's pressure hull (11). The assembly includes a pressure vessel (4) for storing the life raft (5) in a pressurized state. To deploy underwater, a lid (71) covering an opening to the well (7) is released to permit the assembly (3), which is buoyant, to ascend towards the water surface. A sensor (43) determines proximity to the water surface, whereby a pneumatic ram (42) in the pressure vessel is activated to eject the life raft (5) from the pressure vessel (4).

33 Claims, 8 Drawing Sheets

U.S. PATENT DOCUMENTS

| | | | | | |
|---|---|---|---|---|---|
| 4,961,714 | A | * | 10/1990 | Smith | 441/10 |
| 5,170,005 | A | * | 12/1992 | Mabry et al. | 89/1.81 |
| 5,573,343 | A | | 11/1996 | Davis et al. | |

FOREIGN PATENT DOCUMENTS

| | | |
|---|---|---|
| FR | 755198 | 11/1933 |
| FR | 870898 | 3/1942 |
| FR | 2130791 | 2/1971 |
| GB | 130612 | 0/1914 |
| GB | 191307796 | 0/1913 |
| GB | 893226 | 4/1962 |
| WO | WO 03/101828 | 12/2003 |

* cited by examiner

ASSEMBLY FOR DEPLOYING A PAYLOAD FROM A SUBMARINE

BACKGROUND OF THE INVENTION

1. Field of the Invention

The field of this invention relates to apparatus for deploying payloads, e.g. life rafts, from submarines.

2. Summary of the Prior Art

Life rafts are known for use in submarines, and are provided for use in emergency situations, enabling safe abandonment of the submarines.

Standard life rafts are not designed to survive pressures at deep submarine dive depths. Thus, life rafts are usually stored in the submarine's pressure hull, i.e. the main pressurised internal volume of the submarine. This means that the life rafts must be small enough to be carried by a person through an escape hatch of the submarine, and that valuable space in the submarine's pressure hull is consumed whilst they are stored ready for deployment.

SUMMARY OF THE INVENTION

According to a first aspect of the present invention, there may be provided:

a submarine comprising an assembly for deploying a payload from the submarine, the assembly being releasably held on or in the submarine at a position external to the submarine's pressure hull, the assembly including a pressure vessel, having a payload therein, for storing the payload in a pressurized state, the pressure vessel, with payload therein, being buoyant when in water, wherein the pressure vessel includes an opening covered by a releasable cover and a ram for forcing the payload through the opening, the ram having an engagement surface for releasably engaging the payload, the payload being located between the engagement surface and the opening.

The releasable cover may be frangible or may be a one-way pressure cap, which has least resistance to pressure in a direction away from the internal volume of the pressure vessel. Therefore, upon operation of the ram, the ram may force the payload against the releasable cover, causing the cover to break. Thus, the cover may not prevent the payload from being forced through the opening. Alternatively, the cover may be released, e.g. as a single piece, prior to operation of the ram.

The ram is preferably a pneumatic ram. The pneumatic ram may include an air jack, which is connected to a reservoir of compressed air (a 'firing reservoir') via a valve (a 'firing valve'). The air jack may have a flat surface at one end, which acts as the engagement surface for releasably engaging the payload. The firing reservoir may be a standard compressed air bottle. Preferably, when air flows from the firing reservoir into the air jack, the air jack inflates, forcing the payload out of the pressure vessel, e.g. through the frangible cover or one way pressure cap.

Other types of rams may be used instead of a pneumatic ram, for example, the ram may include a small hydraulic accumulator and piston, or even a mechanical spring, released by a small pyrotechnic, electromechanical, pneumatic or hydraulic lock bolt. Nevertheless, conditions required to activate these rams, and the end result of the payload being forced through the opening of the pressure vessel, e.g. through the frangible cap or one way pressure cap, may be the same as for the pneumatic ram.

By being located in the pressure vessel, the payload can be maintained at an appropriate pressure, i.e. a pressure which does not cause it substantial damage, allowing it to be stored outside the submarine's pressure hull.

Thus, valuable space inside the submarine's pressure hull need not be consumed during storage of the payload. Furthermore, the payload need not be small enough to fit through e.g. an escape hatch of the pressure hull.

The term "pressurized state" in relation to the interior of the pressure vessel means that the pressure inside the vessel is different to that outside the vessel. However, the term as used herein preferably means that the pressure inside the pressure vessel will be lower than that outside the vessel, e.g. when the submarine is submerged.

Preferably, the internal pressure of the pressure vessel is approximately equal to atmospheric pressure, i.e. 1 bar. Thus, a payload designed for use only at atmospheric pressure, can be carried by the submarine at deep water depths, without incurring damage. The pressure vessel may also maintain the payload in a dry environment.

Preferably, the assembly is located in a space between the submarine's pressure hull and casing (the outer hull), such as in the submarine's free-flood spaces. However, the assembly may be stored elsewhere, e.g. in a pod fitted to the exterior side of the submarine's casing, or in the bridge fin of the submarine.

The submarine may be modified to include a pocket or a well within which the pressure vessel is stored. The pocket or well is preferably located in the space between the submarine's pressure hull and casing.

The assembly may be located in a support cage. The support cage may be connected to the rest of the submarine via one or more shock mounts which cushion the pressure vessel from shock events.

The releasable cover may be held on the pressure vessel by a retaining strap. One or both of two ends of the retaining strap may be attached via a releasable mechanism to the support cage, allowing a centre portion of the strap between said ends to contact and pass over the releasable cover of the pressure vessel. The retaining strap thus helps to maintain a pressure tight seal at the opening of the pressure vessel under a shock event, and moreover retains the pressure vessel in place relative to the support cage under a shock event.

The strap may be releasable from the support cage by operation of a strap release mechanism inside the pressure hull of the submarine, or from release means mounted on the outer casing of the submarine. Operation of either of these release mechanisms will release the strap and allow the pressure vessel to exit from the support cage under its own buoyancy when the submarine is submerged. When the submarine is not submerged, operation of these release mechanisms will permit the payload to be deployed by the ram.

The strap release mechanism may include one or more rigid shafts that are movable in their axial directions, or are rotatable, or a combination of the two, to a position at which a latch or latches are activated to release the retaining strap from over the top of the vessel.

Alternatively, the strap release mechanism may include one or more hydraulic hoses with closed hydraulic cylinders at the ends thereof. The hydraulic cylinders contain hydraulic fluid at pressure, retained by a suitable diaphragm. Upon operation of the release mechanism, the diaphragm of a master cylinder punctures allowing the release of additional hydraulic fluid into the closed system such that cylinders adjacent to each latch mechanism are operated, thereby to release the strap.

Preferably, the assembly constitutes, or is part of, a life raft deployment system of the submarine, wherein the payload is a life raft, most preferably a containerised life raft.

Preferably, the submarine includes an actuator arranged to release the pressure vessel from the submarine (e.g. the pocket or well of the submarine).

The opening of the pocket or well preferably opens to the environment outside the submarine. Preferably the opening is covered by a releasable lid. The lid may provide a water seal to the pocket or well, or may permit the pocket or well to be 'free flood', wherein the lid merely maintains the 'lines' of the submarine's casing. Preferably, the pocket or well is located at an upper region of the submarine, with the opening of the pocket or well being at an upper region of the pocket or well. With this configuration, since the pressure vessel is buoyant in water, if the lid (and retaining strap, if provided) is released, the holding of the pressure vessel is released and the pressure vessel can rise upwardly through the opening of the water-filled pocket or well, towards the water surface. Therefore, the actuator arranged to launch the pressure vessel from the submarine may need only be a mechanism for releasing the lid of the pocket or well (a lid release mechanism), and a strap release mechanism, if such a strap is provided. Ideally, the lid is buoyant so that, when it is released, it floats away from the pocket or well, toward the water surface, thus preventing it from obstructing the opening of the pocket or well. Alternatively, the lid may be a two-piece lid that splits along its centreline so as to rotate away from the centre of the pocket or well and, thus, provide an unobstructed opening.

In this description, the terms upper, upwardly, lower, above, below etc. are intended to describe the relative positioning of features of the assembly and submarine in normal use, i.e. when the submarine is level. Moreover, pressures quoted in this description are absolute pressures.

Preferably, the lid release mechanism includes one or more rigid shafts that are movable in their axial directions, or are rotatable, or a combination of the two, to a position in which they release one or more latches which secure the lid over the opening of the pocket or well. Alternatively, the lid release mechanism may include one or more hydraulic hoses with closed hydraulic cylinders at the ends. The hydraulic cylinders contain hydraulic fluid at pressure, retained by a suitable diaphragm. Upon operation of the release mechanism, the diaphragm of a master cylinder punctures allowing the release of additional hydraulic fluid into the closed system such that cylinders adjacent to each latch mechanism are operated, thereby to release the lid.

The lid release mechanism and/or the strap release mechanism may include a handle or a manual hydraulic pump to move the one or more rigid shafts, or to cause the diaphragm of the master cylinder to puncture, whichever the case may be. Such a hydraulic pump may be of the sort conventionally used in submarines to operate a hull penetrating actuator. The handle or manual pump may be in a control room of the submarine, or other location accessible by persons onboard. Alternatively, or in addition to the aforementioned internal handle or pump of the lid and/or strap release mechanisms, there may be provided one or more handles on the outer side of the casing of the submarine, operation of which cause operation of the lid and/or strap release mechanisms. Manual release of these external handle(s) may be performed if the submarine has surfaced. However, if the submarine is submerged, operation of the external handle(s) may still be performed by a diver. Preferably, there is some "lost motion" in the release mechanisms, such that operation of the internal handle does not back drive the external handle(s), and vice versa.

It is preferable that the actuator for launching the pressurized vessel, e.g. the mechanism for releasing the lid and/or retaining strap, is manually operable, since the pressurized vessel may need to be launched in an emergency situation where the submarine's normal power supply (platform power) is unavailable.

The lid release mechanism may be linked to the retaining strap release mechanism, such that actuation of the lid release mechanism actuates the retaining strap release mechanism. The linking of the mechanisms may be accomplished by one or more rigid links connected to a release handle, or by a closed hydraulic system that uses a release of stored energy caused by the actuation of a release handle to release the lid and retaining strap.

Preferably, the ram for forcing the payload from the pressure vessel is 'armed', i.e. made ready for use, only once the actuator for launching the pressure vessel is activated (e.g. the latches which secure the lid and, if provided, the retaining strap, have been released manually or otherwise). Essentially this may be a 'first condition' that must be met before the payload can be ejected from the pressure vessel.

As stated above, once the pressure vessel is launched from the submerged submarine, it will ascend toward the water surface (with the payload therein) as a result of its buoyancy. Preferably, the pressure vessel remains sealed as it ascends toward the water surface so as to maintain the preferred internal environment for the payload (e.g. 1 bar pressure). However, preferably, upon reaching the water surface, or at a position close to the water surface, the ram is configured to automatically force the payload from the pressure vessel. To facilitate this, the ram may include a sensor for sensing when the pressure vessel is at or near the water surface. Essentially, when the sensor senses that the pressure vessel is at or near the water surface, a 'second condition' required for launching the payload may be met (further to the 'first condition' discussed above). The sensor may be a pressure sensor for measuring the pressure at the exterior of the pressure vessel, wherein the ram is configured to force the pressure vessel at a predetermined pressure, e.g. a pressure at, or close to, atmospheric pressure (e.g. 1 bar). The registering of a pressure close to atmospheric pressure indicates that the pressure vessel is at, or near, the water surface. Alternatively, the sensor may be, for example, a sonar device. The sonar device may transmit sound waves and may record the time it takes the sound waves to travel from the device, reflect off the water surface, and travel back to the device. The less time it takes for the sound waves to be transmitted and received again in this manner, the closer the device is to the water surface. Therefore, by recording this time, the proximity of the pressure vessel to the water surface may be determined.

Preferably, the ram is configured to force the payload through the opening of the pressure vessel (i.e. eject the payload) only once both the 'first condition' and the 'second condition' have been met, i.e. the actuator for launching the pressure vessel has been activated (e.g. the latches which secure the lid, and retaining strap, if provided, have been released manually or otherwise), and the sensor senses that the pressure vessel is at, or near, the water surface. For example, the firing valve of the pneumatic ram may be configured to open, i.e. permit air to flow from the firing reservoir to the air jack when the 'first and second conditions' have been met. Requiring these two conditions to be met in this manner is advantageous because it may, for example, prevent the payload ram from attempting to eject the payload when the submarine surfaces during normal operation, and a deployed payload is not required.

Preferably, when the payload is a life raft, the action of forcing the life raft from the pressure vessel commences the life raft inflation sequence. For example, if the life raft is configured to inflate upon the removal of a pin (as is common for most containerised life rafts), a lanyard is preferably connected between the pin and the pressure vessel, such that, upon ejection of the life raft, the lanyard is pulled tight and the pin is removed.

The payload may remain connected to the submarine once the payload is deployed. To enable this, a tether may be fitted between the pressure vessel and the submarine and another tether may be fitted between the pressure vessel and the payload. When the assembly forms part of a life raft deployment system, this connection is particularly advantageous, since it will stop the deployed life raft from drifting from the submarine. In this 'end state' of the deployed life raft being connected to the submarine via e.g. flexible tethers which allow a limited range of movement of the deployed life raft relative to the submarine, the life raft will act essentially as distress indicator buoy for the submarine. The life raft's ability to function as a distress indicator buoy will be enhanced if the life raft includes the preferred features of a standard locator beacon and a global positioning system (GPS), which operate once the life raft is deployed.

Of course, appropriate 'end states' for other types of payload will depend on the specifics of these payloads.

The tether fitted between the pressure vessel and the submarine may be stored on a rotatable tether drum such that, when the pressure vessel ascends to the water surface, in use, the tether will wind off the drum. Preferably, the tether drum includes a friction brake, which controls the speed at which the drum rotates, and thus the speed at which the tether unwinds from the drum. Preferably, the friction brake is configured such that the tether remains taut during the ascent of the pressure vessel, as this may prevent the tether getting tangled, or catching on part of the submarine or another object, during the ascent.

Preferably, the connection between the tether and the submarine is sufficiently weak such that, in the event of the submarine being deeper than the available length of tether, the tether will disconnect from the submarine. Alternatively, the tether may be sufficiently long to allow the pressure vessel to reach the water surface up to the maximum diving depth of the submarine. These fall-back positions mean that the pressure vessel is never prevented from reaching the surface by the tether.

The tether fitted between the pressure vessel and the payload may be coiled in the pressure vessel whilst the payload is located in the pressure vessel, but may pay-out when the payload is ejected from the pressure vessel, e.g. at the water surface. This tether may be shorter than the tether fitted between the submarine and the pressure vessel, since the pressure vessel and the payload need not move far apart on the water surface.

Although the assembly of the present invention is suitable for deploying a payload from the submerged submarine, it may also be suitable for deploying the payload from the submarine when it has surfaced. If the submarine has surfaced, the pressure vessel may be unable to float from the pocket or well of the submarine, and may remain situated therein. However, one of the conditions (the 'second condition') required for the ram to eject the payload may have been met in this state (e.g. 1 bar pressure may have been recorded by a pressure sensor). Therefore, as soon as the latches securing the lid, and retaining strap if provided, are released, e.g. directly by hand or via the rigid shaft or hydraulic system etc., and the ram "arming" mechanism has been activated, the payload may be ejected from the pressure vessel. When the assembly is used to deploy a life raft, in particular a containerised life raft, the life raft may proceed to inflate upon ejection and is likely to remain on the surface of the submarine casing. However, there should be sufficient length in the tether connecting the life raft and the pressure vessel to enable the life raft to slide into the surrounding water, ready for occupancy.

The simplicity of this arrangement, in which the assembly of the present invention may deploy a payload from both a submerged or surfaced submarine using the same procedure, is a key advantage of the first aspect of the present invention.

According to a second aspect of the present invention, there may be provided:

a submarine comprising an assembly for deploying a payload from the submarine, the assembly being releasably held on or in the submarine at a position external to the submarine's pressure hull, the assembly including a pressure vessel, having a payload therein, for storing the payload in a pressurized state, the pressure vessel, with payload therein, being buoyant when in water;

wherein the pressure vessel includes a sensor for sensing whether the pressure vessel is at or near the water surface; and wherein the pressure vessel has an opening covered by a releasable cover, and a cover release mechanism for releasing said cover from the opening when the sensor senses that the pressure vessel is at or near the water surface.

Preferably, the sensor is the same or similar to the sensor as described with respect to the first aspect of the invention. For example, the sensor may be the pressure sensor or the sonar device as described above.

It is preferable for the release mechanism to include the payload itself, or some suitable additional case, with the payload or case being forced against the cover to release it. Other release mechanisms, such as latches, springs etc. are also possible.

The cover may be releasable as a single piece or may be frangible so that breaking the frangible cover removes it from the opening.

Preferably, the payload is a life raft, e.g. a containerised life raft. Preferably, the cover release mechanism includes the ram as described with respect to the first aspect of the invention, the sensor being a component of the ram. Preferably, the cover is the same or similar to the cover as described above with respect to the first aspect of the present invention. Preferably, the pressure vessel includes the tether as described above with respect to the first aspect of the present invention.

According to a third aspect of the present invention, there may be provided:

a pressure vessel for deploying a payload from a submarine;

wherein the pressure vessel includes an opening covered by a releasable cover and a ram for forcing the payload through the opening, the ram having an engagement surface for releasably engaging the payload, the pressure vessel being capable of storing the payload between the engagement surface and the opening in a pressurized state.

Preferably, the ram and the cover are the same or similar to the ram and cover as described with respect to the first aspect of the present invention. Preferably, the payload is a life raft, e.g. a containerised life raft. Preferably, the pressure vessel includes the lid, and/or the tether as described with respect to the pressure vessel of the first aspect of the invention.

According to a fourth aspect of the present invention, there may be provided:

a pressure vessel for deploying a payload from a submarine, the pressure vessel being capable of storing the payload in a pressurized state;

wherein the pressure vessel includes a sensor for monitoring whether the pressure vessel is at or near the water surface; and wherein the pressure vessel has an opening covered by a releasable cover, and a cover release mechanism for releasing said cover from the opening when the sensor senses that the pressure vessel is at or near the water surface.

Preferably, the sensor is the same or similar to the sensor as described with respect to the first aspect of the invention. For example, the sensor may be the pressure sensor or the sonar device as described above.

It is preferable for the release mechanism to include the payload itself, or some suitable additional case, with the payload or case being forced against the cover to release it when at the appropriate pressure. Other release mechanisms, such as latches, springs etc. are also possible.

The cover may be releasable as a single piece or may be frangible so that breaking the frangible cover removes it from the opening.

Preferably, the payload is a life raft, e.g. a containerised life raft. Preferably, the cover release mechanism includes the ram as described with respect to the first aspect of the invention, the sensor being a component of the ram. Preferably, the cover is the same or similar to the cover as described above with respect to the first aspect of the present invention. Preferably, the pressure vessel includes the tether as described above with respect to the first aspect of the present invention.

According to a fifth aspect of the present invention there may be provided:

an assembly for deploying a payload from a submarine, the assembly being releasably mountable to the submarine at a position external to the submarine's pressure hull, the assembly including the pressure vessel according to the third or fourth aspect of the present invention with the payload located therein, the pressure vessel, with payload located therein, being buoyant when in water.

Preferably the payload is a life raft, e.g. a containerised life raft.

BRIEF DESCRIPTION OF THE DRAWINGS

Embodiments of the present invention will now be described in detail, by way of example, with reference to the accompanying drawings, in which.

DETAILED DESCRIPTION

Figure 1:
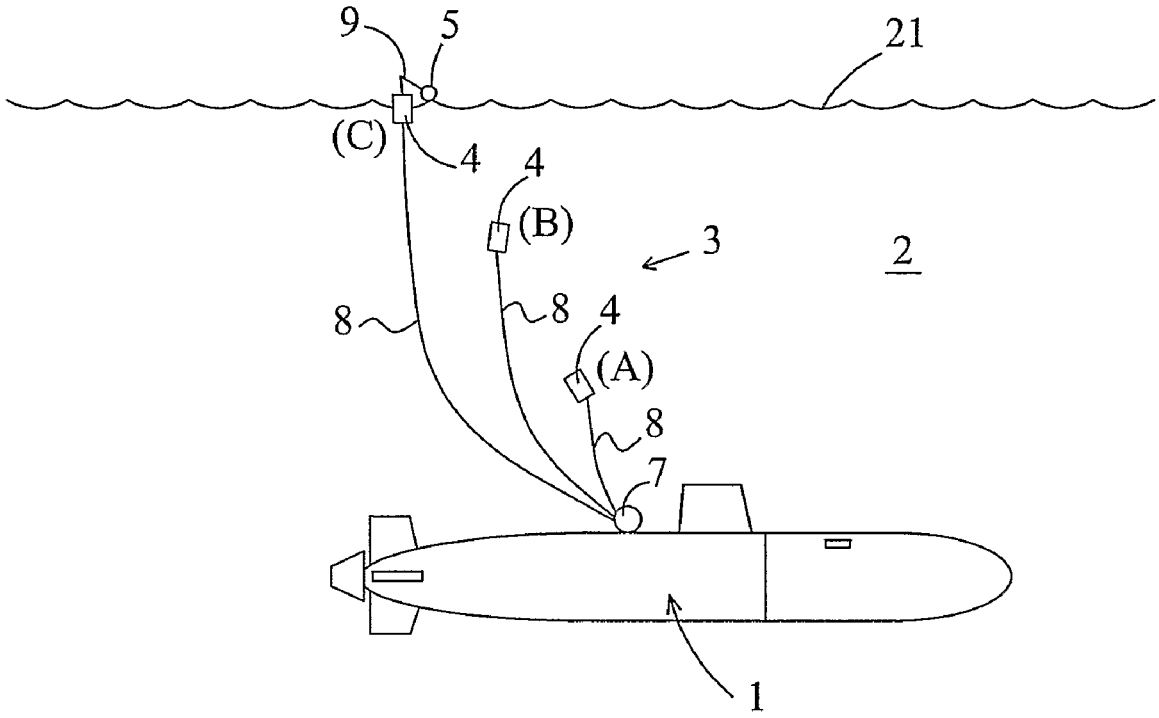
FIG. 1 shows the deployment of a life raft from a submerged submarine according to the present invention.

A submarine 1 according to the present invention is shown in FIG. 1, which is submerged in water 2 (e.g. the sea). The surface 21 of the water 2 is represented by a wavy line.

The submarine 1 is fitted with an assembly 3. This assembly 3 constitutes a life raft deployment system and includes a pressure vessel 4 and a containerised life raft 5. Before deployment, the life raft 5 is stored in the pressure vessel 4 at atmospheric pressure, and the pressure vessel 4 is stored in an enclosure, e.g. a well 7, situated at an upper region of the submarine, outside the submarine's main pressure hull 11. For simplicity, in FIG. 1, the well 7 is represented by a circle, protruding from the submarine 1. However, in reality, the well is e.g. located between the submarine's pressure hull 11 and the submarine's outer casing 12 as shown in FIGS. 2 to 4, FIGS. 5 to 7, and FIG. 8, providing there is sufficient space between the casing and the pressure hull to allow the system to be installed. Thus, the 'lines' of the submarine need not be affected by the inclusion of the assembly 3, and valuable space inside the submarine's pressure hull need not be consumed.

A mechanism is provided to launch the pressure vessel 4 from the well 7, whereupon it can ascend, due to its buoyancy, toward the water surface 21, as represented by its relative positioning at (A) and (B) in FIG. 1. During the ascent, the life raft 5 remains sealed at atmospheric pressure, in the pressure vessel 4.

Upon reaching the surface 21, as shown at (C) in FIG. 1, a ram is arranged to launch the life raft 5 from the pressure vessel 4, whereupon the life raft 5 will inflate, ready for occupancy.

A tether 8 is fitted between the submarine 1 and the pressure vessel 4 and a tether 9 is fitted between the pressure vessel 4 and the life raft 5. Thus, when the life raft 5 has been deployed, contact between the life raft 5 and the submarine 1 may be maintained. This prevents the life raft 5 from drifting from the submarine 1 after deployment, and allows the life raft 5 to act, essentially, as a distress indicator buoy for the submarine 1.

The configuration and performance of the pressure vessel 4, containerised life raft 5, well 7 and other features of three embodiments of the invention, will now be described in more detail with reference to FIGS. 2 to 4, FIGS. 5 to 7, and FIG. 8 respectively.

Figure 2:
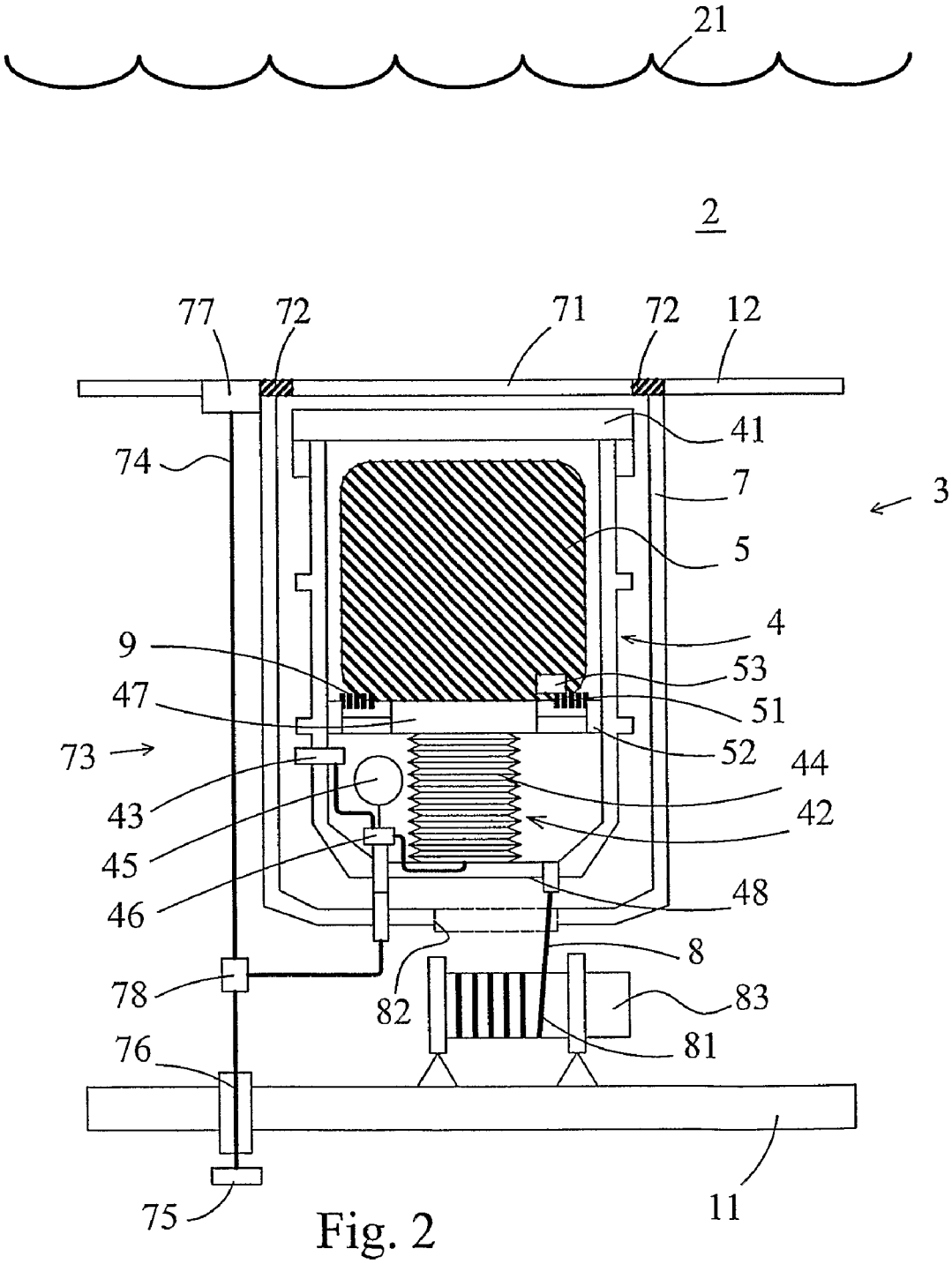
FIG. 2 shows a first embodiment of an assembly of the submarine of FIG. 1 in a state prior to deployment of the life raft.

FIG. 2 shows a first embodiment of the assembly of the invention. This figure shows the pressure vessel 4 located in the well 7 before deployment. The opening of the well 7 is positioned at the upper end of the well 7, and is covered by a buoyant lid 71, which is flush with the outer casing 12 of the submarine. The lid 71 is held in position by releasable catches 72. The lid 71 seals the well 7, preventing water ingress, although the well may or may not be free flood.

A latch release mechanism 73 is provided to the exterior of the well 7. The latch release mechanism 73 includes a rigid shaft 74 with first and second ends. The first end is located inside the pressure hull 11 and is connected to a handle 75. The rigid shaft extends, from the handle 75, through a shaft sealed hole 76 of the pressure hull 11, and through the region between the pressure hull 11 and the outer casing 12. The second end of the rigid shaft 74 is connected to an element 77 which cooperates with the latches 72. In use, the lid release mechanism 73 is operated by moving the handle 75, which in turn causes the rigid shaft to move the element 74 in such a manner as to release the latches 72.

Figure 3:
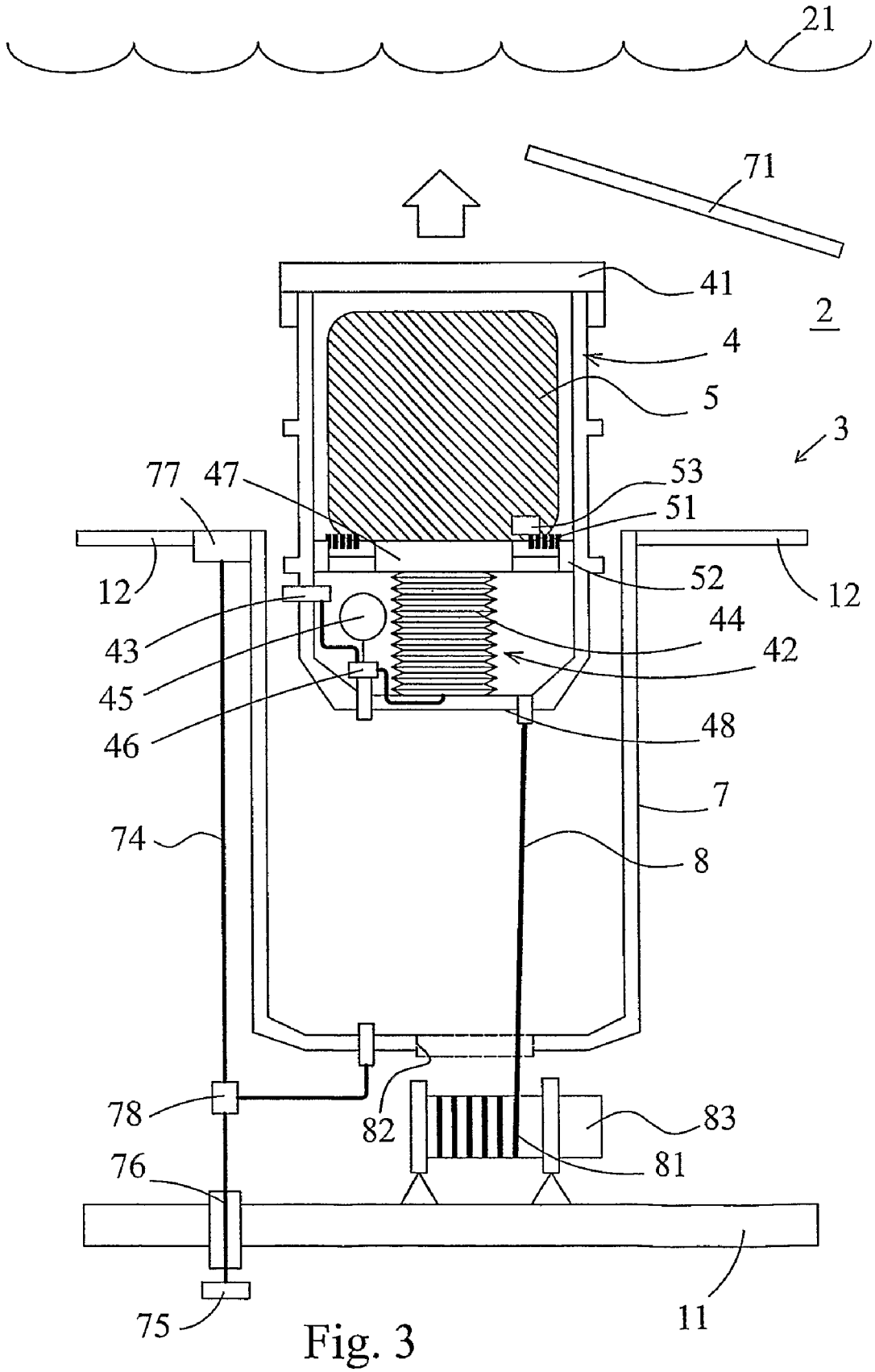
FIG. 3 shows the first embodiment of the assembly of the submarine of FIG. 1 during the early stages of the life raft deployment.

FIG. 3 shows the assembly of this embodiment in a state soon after operation of the latch release mechanism 73. The latch release mechanism 73 has operated to release the latches 72, thus freeing the lid 71. Since the lid 71 is buoyant, it can float away from the opening of the well 7, leaving the opening unobstructed, as shown in FIG. 3. Furthermore, since the pressure vessel 4 is buoyant, it can rise through the unobstructed opening of the well 7, toward the water surface 21, as also shown in FIG. 3. Thus, mere release of the latches 72 is sufficient to launch the pressure vessel 4 from the well 7.

The tether 8 is fitted between the bottom 48 of the pressure vessel 4 and a tether drum 81 (located externally to the well 7) through a port 82 at the bottom of the well 7. The tether 8 is wound round the tether drum 81, for storage, before the pressure vessel is launched from the well 7. As the pressure vessel 4 ascends toward the water surface 21, the tether drum 81 rotates, and the tether 8 unwinds from the tether drum 81.

The tether drum 81 includes a friction brake 83, which controls the rotation speed of the tether drum 81, and thus the speed at which the tether 8 can unwind from the drum 81, so that the tether 8 remains taut during the ascent of the pressure vessel 4 toward the water surface 21. This reduces the likelihood that the tether 8 gets tangled during the ascent.

The connection between the tether 8 and the tether drum 81 is sufficiently weak such that, in the event of the submarine 1 being deeper than the available length of tether 8, the tether 8 will disconnect from the submarine 1. This means that the pressure vessel 4 can never be prevented from reaching the surface 21 by the tether 8. As shown in FIGS. 2 and 3, the pressure vessel 4 has the containerised life raft 5 located therein. The pressure vessel 4 is sealed by a cover (a one-way pressure cap 41) at its upper end, and the internal pressure of the pressure vessel 4 is atmospheric pressure, i.e. 1 bar.

Figure 4:
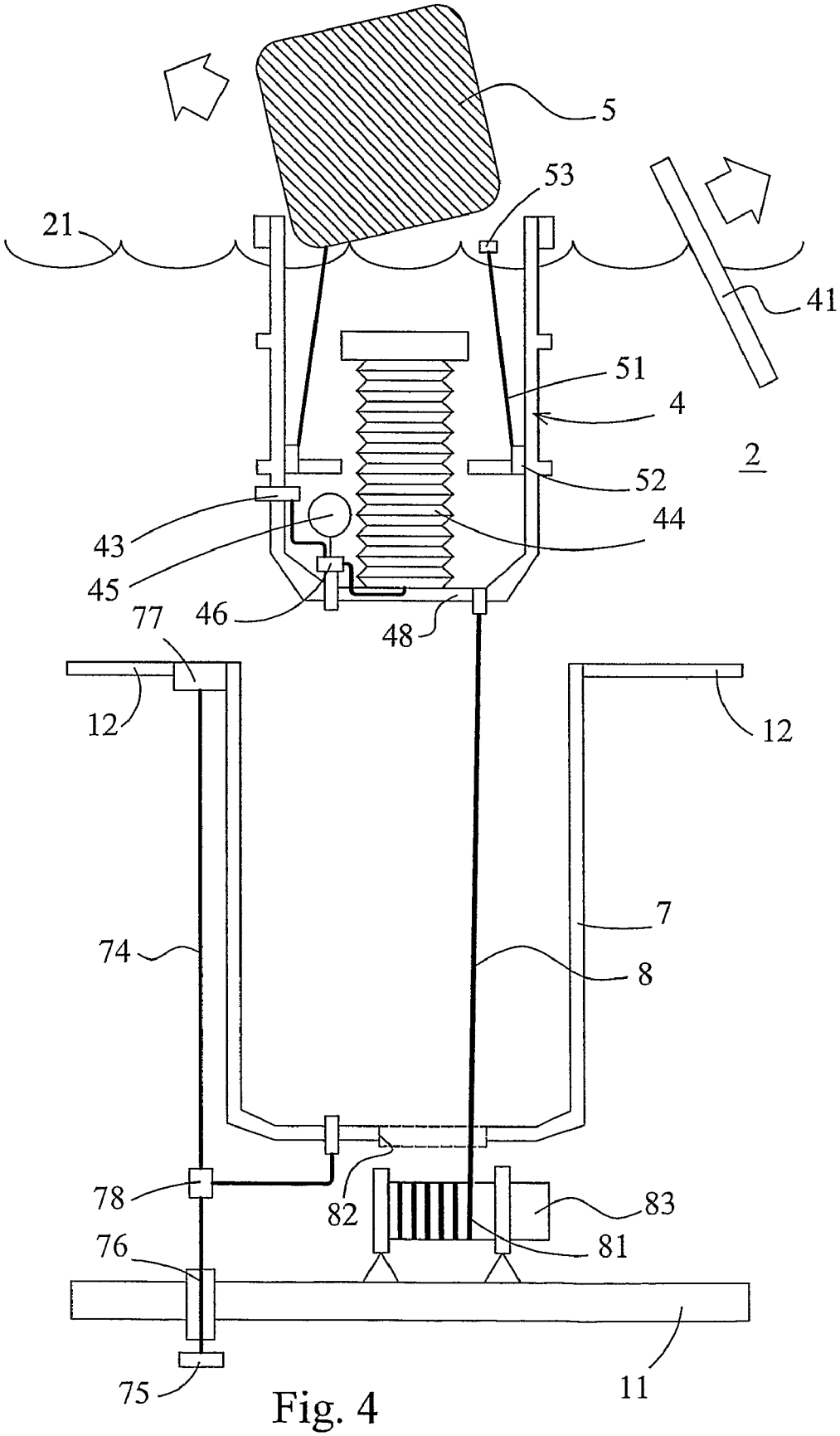
FIG. 4 shows the first embodiment of the assembly of the submarine of FIG. 1 during the later stages of the life raft deployment.

A ram 42 is provided in the pressure vessel 4, which operates to eject the life raft 5 from the pressure vessel 4 upon the pressure vessel 4 reaching the water surface 21 (as shown in FIG. 4). However, the ram 42 is only 'armed' once the latch release mechanism 73 has operated to release the latches 72. This is achieved by using an interlock mechanism 78 which is mechanical in nature and which cooperates with both the latch release mechanism 73 and the ram 42.

For the ram 42 to recognise that the pressure vessel 4 is at, or near the water surface 21, the ram 42 includes a pressure sensor 43 for measuring the pressure at the exterior of the pressure vessel 4. The registering of a pressure of 1 bar absolute (atmospheric pressure), by the pressure sensor 43, indicates that the pressure vessel 4 is at, or near, the water surface 21.

The ram 42 includes an air jack 44, which is located below the life raft 5 and is connected to a reservoir of compressed air (firing reservoir 45) via a valve (firing valve 46). The firing reservoir 45 is e.g. a standard compressed air bottle. The interlock 78 is connected to the firing valve 46 so as to arm the firing valve 46 (i.e. make the firing valve 46 ready for use) when the latch release mechanism 73 has operated to release the latches 72. Once the firing valve 46 is armed, when the pressure sensor registers 1 bar, the firing valve is configured to open, i.e. permit air to flow from the firing reservoir 45 to the air jack 44. Since the firing valve 46 must be armed in this manner before it can operate, the ram 42 is prevented from attempting to eject the life raft 5 when the submarine surfaces during normal use (i.e. when life raft deployment is not required).

When the firing valve 46 opens, air flows from the firing reservoir 45 into the air jack 44, causing the air jack 44 to inflate. The life raft 5 is located on a platform 47 above the air jack. As the air jack 44 inflates, the platform 47 is forced upwardly, and thus the life raft 5 is forced against the cap 41. The cap 41 is a one way pressure cap which is least resistant to pressure in a direction away from the interior of the pressure vessel. Thus, when the life raft 5 is forced against the cap 41, the cap 41 gives way, and the life raft 5 is ejected from the pressure vessel 4, as shown in FIG. 4. It is understood that a frangible cap could be used instead of the one way pressure cap 41, with the same effect being achievable.

In this embodiment, the assembly 3 is configured so that ejection of the life raft 5 from the pressure vessel 4 initiates inflation of the life raft 5. To achieve this, a lanyard 51 is connected between the pressure vessel 4, via a connector 52, and a pin 53 of the life raft 5. In operation, upon ejection of the life raft 5, the lanyard 51 is pulled tight and the pin 53 is removed. Removal of the pin 53 initiates inflation of the life raft 5. The life raft 5 remains in contact with the pressure vessel 4 via the tether 9.

Figure 5:
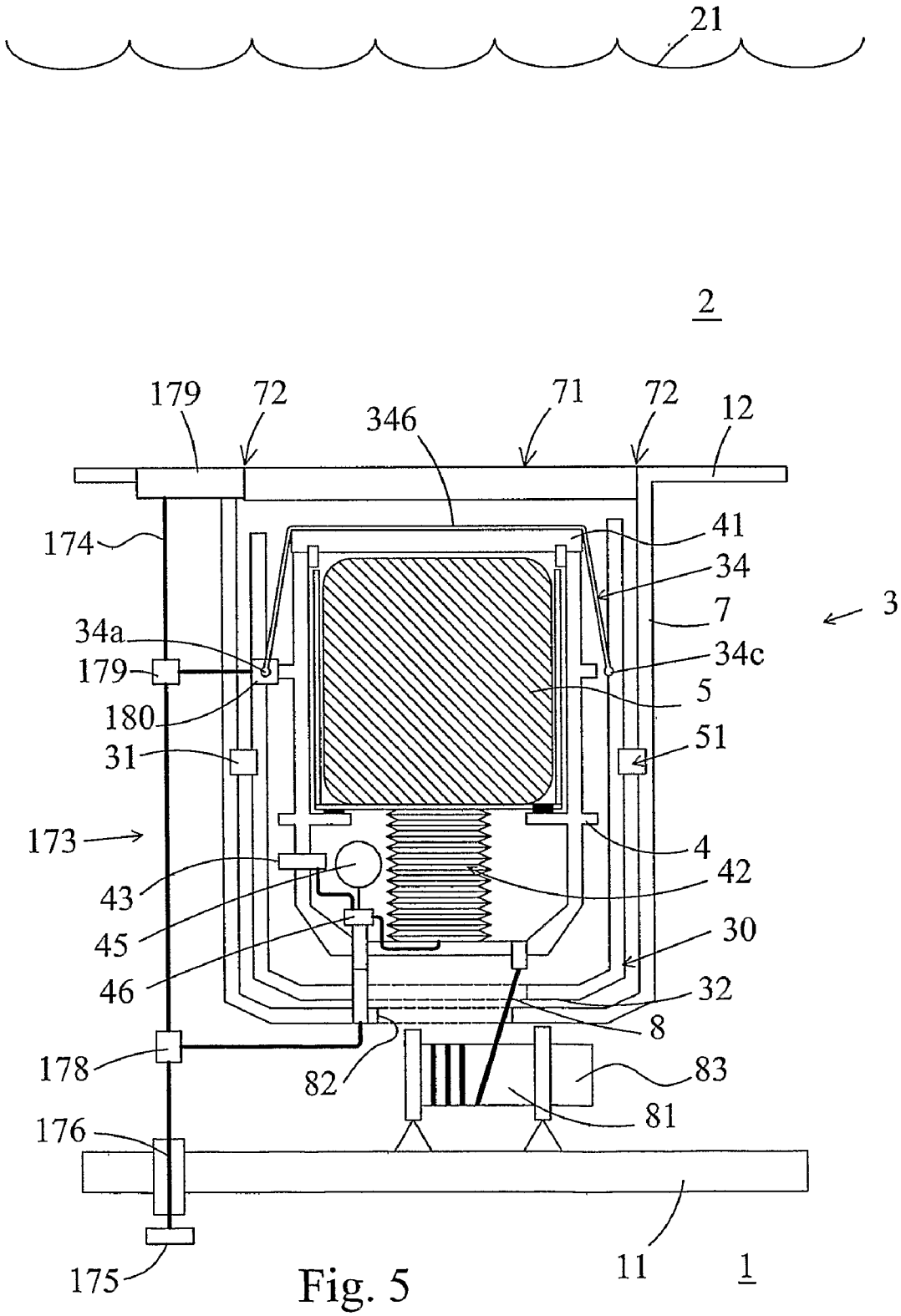
FIG. 5 shows a second embodiment of an assembly of the submarine of FIG. 1 in a state prior to deployment of the life raft.
Figure 6:
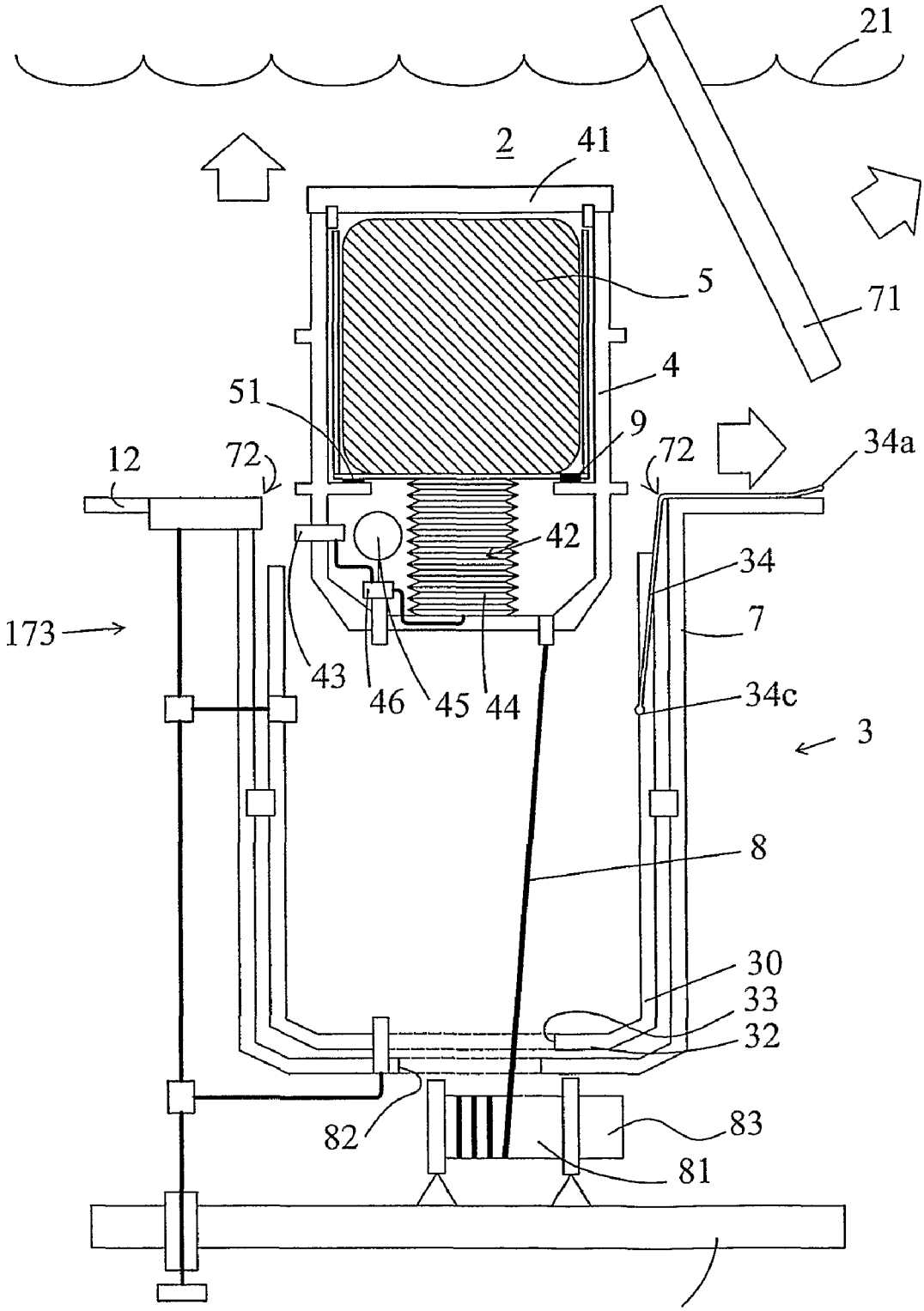
FIG. 6 shows the second embodiment of the assembly of the submarine of FIG. 1 during the early stages of the life raft deployment.
Figure 7:
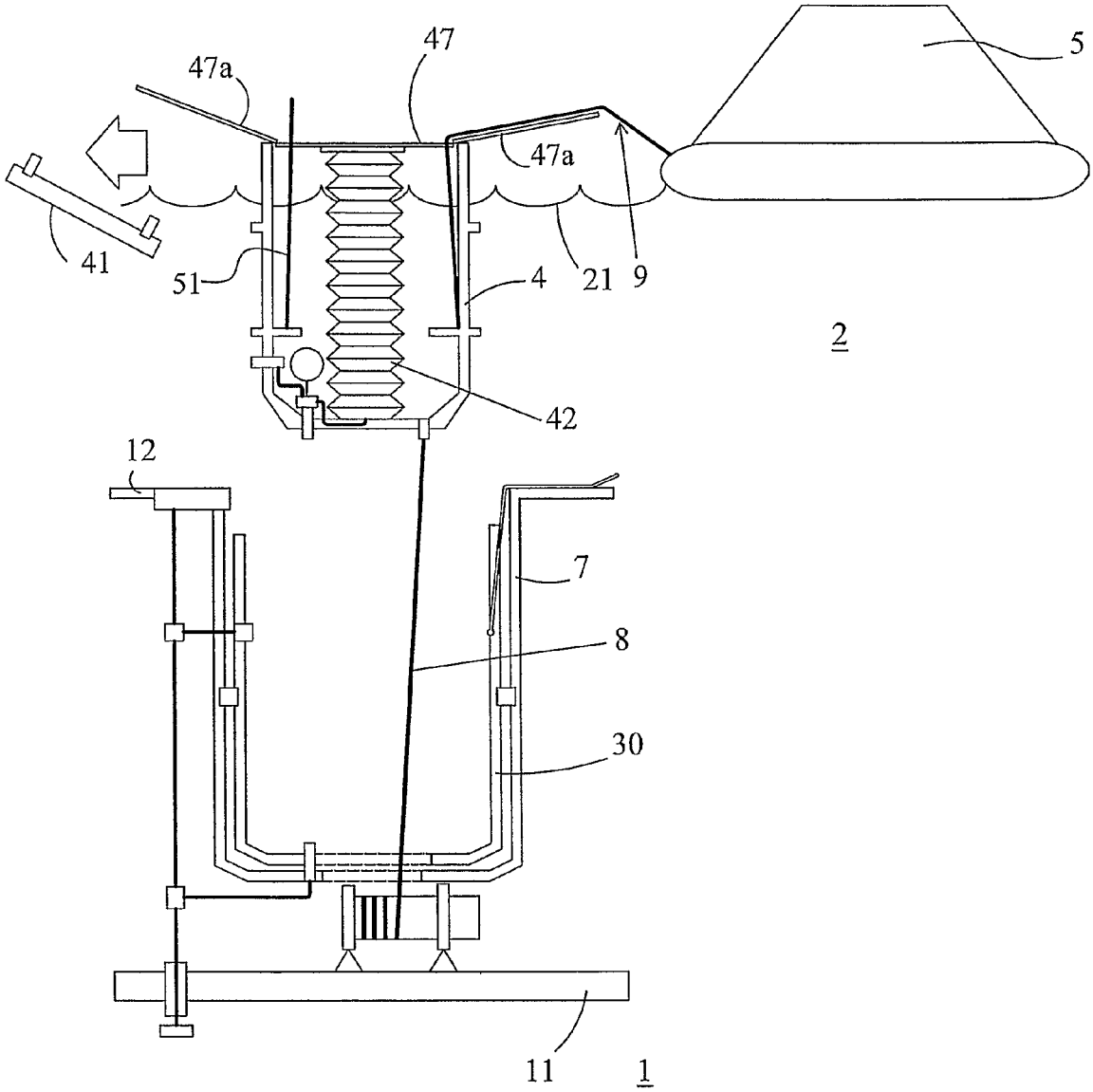
FIG. 7 shows the second embodiment of the assembly of the submarine of FIG. 1 during the later stages of the life raft deployment.

FIGS. 5 to 7 illustrate a second embodiment of the present invention. Elements of the second embodiment which are similar or identical to equivalent elements of the first embodiment are indicated with the same reference numerals and a detailed description thereof is omitted.

As shown in FIG. 5, the submarine 1 is fitted with an assembly 3. This assembly 3 constitutes a life raft deployment system and includes a buoyant pressure vessel 4 and a containerised life raft 5 located therein. The pressure vessel 4 is sealed by a one-way pressure cap 41 at its upper end, and the internal pressure of the pressure vessel 4 is atmospheric pressure, i.e. 1 bar. The pressure vessel 4 is shown in FIG. 5 located in a well 7 in the submarine 1 before deployment. The arrangement of the opening of the well 7 and the buoyant lid 71 thereof is as for the first embodiment. Within the well 7 is provided a support cage 30 which surrounds the pressure vessel 4. The support cage 30 is held in place in the well 7 via shock mounts 31, which protect the pressure vessel 4 from shock events.

Two ends 34*a*, 34*c* of a retaining strap 34 are connected to the support cage 30, while a central portion 34*b* of the retaining strap 34 contacts the cap 41 of the pressure vessel 4 in order to hold the cap 41 in place. The strap 34 maintains a pressure-tight seal of the pressure vessel 4 following the application of tension in the strap 34 using a turnbuckle arrangement, and may be released by operation of the release mechanism 173. The strap 34 also retains the pressure vessel 4 relative to the support cage 30 under a shock event, and prevents the vessel 4 from floating upwards in the well 7 if the well 7 is free to flood when the submarine 1 is submerged.

The release mechanism 173 exterior to the well 7 is different to the mechanism 73 of the first embodiment, in that it comprises a closed hydraulic system including a plurality of interconnected flexible hydraulic hoses. Main hose 174 in the region between the pressure hull 11 and outer casing 12 of the submarine 1 has a first end connected to handle 175 within the pressure hull 11 via a shaft 176. The shaft 176 extends from the handle 175, through a sealed hole of the pressure hull 11, and into the region between the pressure hull 11 and the outer casing 12 of the submarine 1. The second end of the main hose 174 is connected to a first element 177 which cooperates with latches 72 such that operation of element 177 moves the latches 72 between locked and unlocked states.

Part way along the main hose 174 are provided first and second fluid junctions 178, 179. A first branch hose runs from the first fluid junction 178 to a firing valve 46 connected to the ram 42. The firing valve 46 and ram 42 are arranged to operate as in the first embodiment. A second branch hose runs from the second fluid junction 179 to a second element 180, which cooperates with an end 34*a* of the retaining strap 34, such that operation of element 180 releases the end 34*a* of the strap 34 from the support cage 30.

Actuation of the handle 175 releases stored energy to perform three simultaneous operations: latches 72 are released following their cooperation with element 177, thus allowing lid 71 to lift from the opening of the well 7, end 34*a* of the strap 34 is disconnected from the support cage 30, thereby releasing the pressure applied to the cap 41 of the pressure vessel 4, and the firing valve 46 is 'armed', as in the first embodiment. (It will be appreciated that a similar three-way effect can be achieved with the present invention by using the mechanical system of the first embodiment with an additional interlock in the rigid shaft 74 which allows actuation of the handle 75 to cause disconnection of the strap 34 from the support cage 30).

Following actuation of the handle 175, and thus operation of the release mechanism 173, the state shown in FIG. 6 is reached. FIG. 6 shows that the buoyant lid 71 has been freed and is floating away from the opening of the well 7. The drawing also shows that the end 34*a* of the retaining strap 34 is no longer attached to the support cage 30. The other end 34*c* of the strap 34 remains attached to the support cage 30, though it will be appreciated that in other embodiments both ends 34*a*, 34*c* may be detached from the support cage 30. Thus, mere activation of the handle 175 to operate latches 72 and disconnect the retaining strap 34 from the support cage 30 is sufficient to launch the buoyant pressure vessel 4 from the well 7 toward the water surface 21.

The arrangement of the tether 8 between the submarine 1 and the pressure vessel 4, the tether 9 between the pressure vessel 4 and the life raft 5, and the tether drum 81 and brake 83 is much the same as for the first embodiment. However, the tether 8 passes through a port 33 formed in the bottom 32 of the support cage 30, as well as through a port 82 formed in the bottom of the well 7. As the pressure vessel 4 ascends towards the water surface 21, the tether drum 81 rotates, and the tether 8 unwinds from the tether drum 81. The tether 8 is sufficiently long that the pressure vessel 4 is able to reach the water surface 21 from the maximum diving depth of the submarine 1.

As the pressure vessel 4 approaches the water surface 21, the registering of a pressure of less than 1.54 bar absolute (i.e. slightly above atmospheric pressure) by a pressure sensor 43 of the ram 42 indicates that the pressure vessel 4 is at, or near, the water surface 21. In other embodiments of the invention, the pressure required to be sensed to indicate that the vessel 4 is at, or near, the water surface 21 may be a pressure less than 1.24 bar absolute. As in the first embodiment, once the firing valve 46 is armed following operation of the release mechanism 173, when the pressure sensor 43 registers the required pressure (above), the firing valve 46 is configured to open, i.e. to permit air to flow from the firing reservoir 45 to the air jack 44. The ejection of the life raft 5 from the pressure vessel 4 and inflation of the life raft 5 is then as in the first embodiment. A lanyard 51 is connected between the pressure vessel 4 and a pin of the life raft 5. Thus, upon ejection of the life raft 5, the lanyard 51 is pulled tight and the pin is removed from the life raft 5, which initiates inflation of the life raft 5. The position shown in FIG. 7 is therefore reached.

The platform 47 in this embodiment has petals 47*a* in addition to the central portion shown in the first embodiment, such that the platform 47 and petals 47*a* form a secondary container around the life raft 5. These petals 47*a* protrude from the perimeter of the platform 47 and aid guidance of the life raft 5 out of the pressure vessel 4 and prevent it from being damaged due to rubbing against the walls of the pressure vessel 4 as it is ejected.

Upon inflating on the surface, the life raft is subject to sea-way motion, wave and wind action, and the drag of the pressure vessel. The connection between the tether 9 and the life raft 5 is sufficiently strong that the life raft will remain attached to the submarine in the majority of weather conditions. In the event that the weather induces loads liable to damage the life raft, the connection between the life raft 5 and the tether 9 is sufficiently weak to disconnect the life raft from the pressure vessel 4 before the life raft sustains damage due to its attachment to the pressure vessel.

Figure 8:
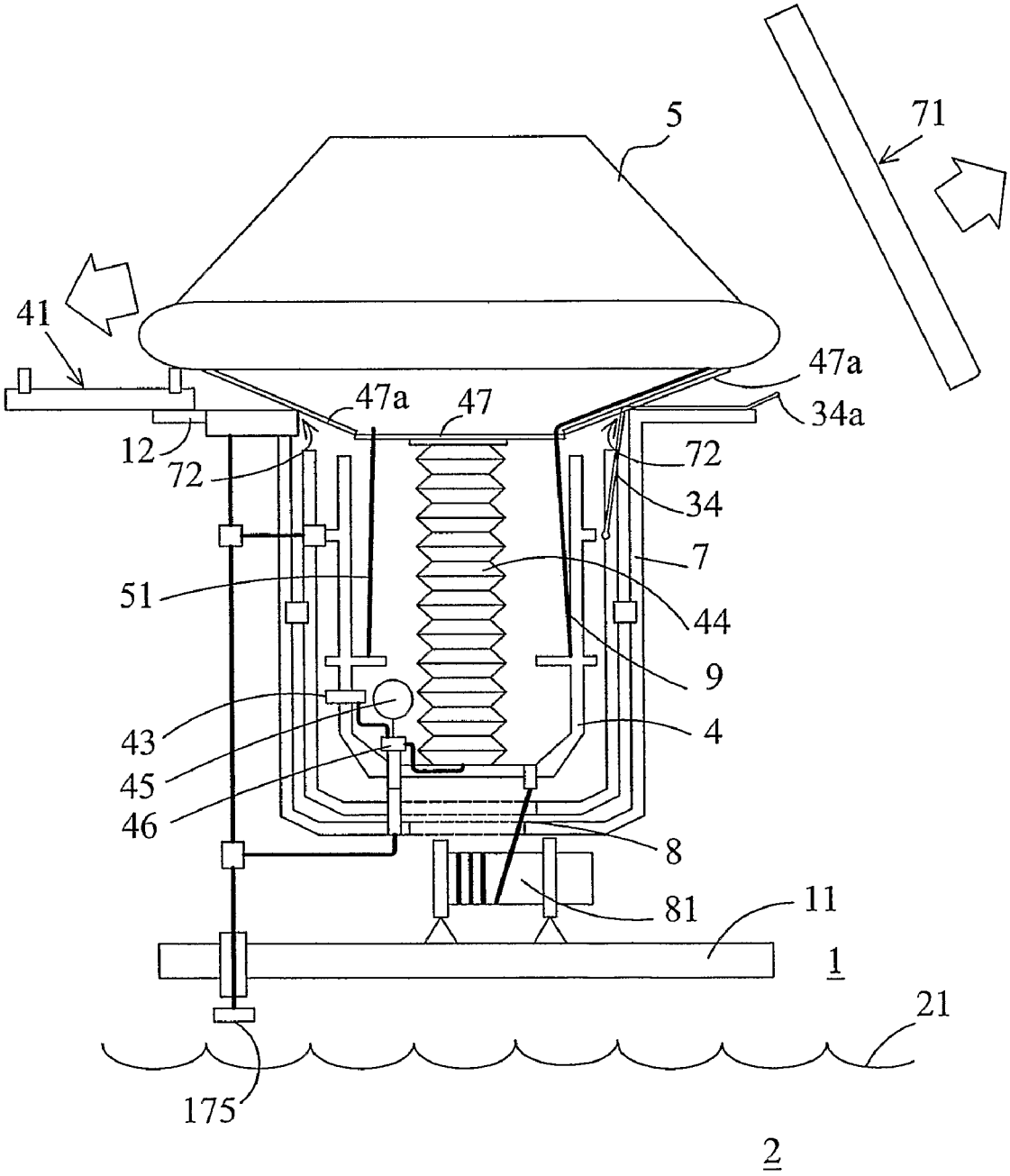
FIG. 8 shows a third embodiment of the assembly of the submarine in FIG. 1 where the life raft has deployed after the submarine has surfaced.

A third embodiment of the present invention is illustrated in FIG. 8. The assembly of the invention is identical to that described in relation to the second embodiment of the invention, but in this case the life raft has been deployed after the submarine has surfaced.

The handle 175 in FIG. 8 has been operated to 'arm' the firing valve 46, to release latches 72 to allow the lid 71 to be removed, and to release end 34*a* of the retaining strap 34 from the support cage 30, to allow the cap 41 to be displaced. However, because the submarine is on the water surface 21, the pressure vessel 4 does not rise out of the well 7 as in the first and second embodiments, and so the tether 8 does not unwind from the tether drum 81. Instead, as the pressure sensor 43 detects a pressure equivalent to atmospheric pressure, the firing valve 46 opens and permits air to flow from the firing reservoir 45 to the air jack 44. The life raft 5 is forced upwards by the air jack 44 to displace the cap 41.

As shown in FIG. 8, the life raft 5 is located within a secondary container identical to that in the second embodiment, the secondary container comprising wings 47*a* protruding from a platform 47. In addition to the advantages of the secondary container stated above in relation to the second embodiment, in this third embodiment the secondary container has the added advantage that it prevents the life raft 5 from getting trapped between the support cage 30 and the casing 12 of the submarine 1 as it is ejected. With the petals 47*a* of the container opening up after the platform 47 is raised by the air jack 44, the life raft 5 is able to 'climb' out of the recess and onto the casing 12 without sustaining damage. (Such a secondary container may also be employed in the system of the first embodiment, i.e. in systems without a support cage or a retaining strap).

As in the previous embodiments, this action of forcing the life raft 5 (and secondary container) upwards by the air jack 44 tensions a lanyard 51 connected between the pressure vessel 4 and a pin of the life raft 5, thus pulling the pin from the life raft 5 to initiate inflation of the life raft 5. The life raft 5 remains attached to the pressure vessel 4 via the tether 9 between them, and may sit on the outer casing (deck) 12 of the submarine 1, or slide overboard into the sea 2, depending on the surrounding environmental conditions.

The invention claimed is:

1. A submarine comprising an assembly for deploying a payload from the submarine, the assembly being releasably held on or in the submarine at a position outside the submarine's pressure hull and including a pressure vessel storing the payload in a pressurized state, the assembly being buoyant in water when the payload is stored in the pressure vessel, wherein the pressure vessel includes an opening covered by a releasable cover, the pressure vessel also including a ram for forcing the payload through the opening, the ram having an engagement surface for releasably engaging the payload, the payload being located between the engagement surface and the opening, and wherein the assembly includes a sensor for sensing whether it is at or near the water surface, and wherein the ram is arranged to force the payload through the opening if the sensor senses that it is at or near the water surface.

2. A submarine according to claim 1, wherein the assembly is arranged to enable the ram for use after it is released from the submarine.

3. A submarine according to claim 1, wherein the ram includes an inflatable air jack connected via a firing valve to a reservoir of compressed air.

4. A submarine according to claim 1, wherein the releasable cover is held onto the pressure vessel by a retaining strap, wherein the submarine includes a strap release mechanism connected to the retaining strap and arranged to release the strap from the releasable cover on operation of an actuator.

5. A submarine according to claim 4, wherein the assembly is located in a well which includes an opening to an environment outside the submarine, the opening being covered by a detachable lid, wherein the submarine includes a lid release mechanism connected to the lid and arranged to release the lid from the opening on operation of an actuator.

6. A submarine according to claim 5, wherein the actuator is connected to both the strap release mechanism and the lid release mechanism, such that operation of the actuator causes operation of both the strap release mechanism and the lid release mechanism.

7. A submarine according to claim 1, wherein the payload includes a life raft.

8. A submarine comprising an assembly for deploying a payload from the submarine, the assembly being releasably held on or in the submarine at a position outside the submarine's pressure hull and including a pressure vessel storing the payload in a pressurized state, and the payload is connected to the submarine after being released from the pressure vessel, the assembly being buoyant in water when the payload is stored in the pressure vessel, the pressure vessel having an opening covered by a releasable cover, and wherein the assembly includes a sensor for sensing whether it is at or near the water surface, and the pressure vessel has a cover release mechanism arranged to release the cover from the opening if the sensor senses that it is at or near the water surface.

9. A submarine according to claim 8, wherein the sensor is a pressure sensor or a sonar device arranged to sense proximity to a water surface.

10. A submarine according to claim 8, wherein the cover release mechanism comprises a ram for forcing the payload through the opening, the ram having an engagement surface for releasably engaging the payload, the payload being located between the engagement surface and the opening.

11. A submarine according to claim 8, wherein the releasable cover is held onto the pressure vessel by a retaining strap, and wherein the submarine includes a strap release mechanism connected to the retaining strap and arranged to release the strap from the releasable cover on operation of an actuator.

12. A submarine according to claim 11, wherein the assembly is located in a well which includes an opening to an environment outside the submarine, the opening being covered by a detachable lid, wherein the submarine includes a lid release mechanism connected to the lid and arranged to release the lid from the opening on operation of an actuator.

13. A submarine according to claim 12, wherein the assembly is located in a well which includes an opening to an environment outside the submarine, the opening being covered by a detachable lid, wherein the submarine includes a lid release mechanism connected to the lid and arranged to release the lid from the opening on operation of an actuator.

14. A submarine according to claim 8, wherein the assembly is located in a support cage, which support cage is connected to the rest of the submarine via at least one shock mount.

15. A submarine according to claim 14, wherein the assembly is held within the support cage by a retaining strap, wherein the submarine includes a strap release mechanism connected to the retaining strap and arranged to release the strap from the support cage on operation of an actuator.

16. A submarine according to claim 8 including an actuator for launching the assembly from the submarine.

17. A submarine according to claim 8, wherein the assembly is located in a well formed between the submarine's pressure hull and outer hull.

18. A submarine according to claim 17, wherein the well includes an opening to an environment outside the submarine, the opening being covered by a detachable lid, whereby detaching the lid causes the assembly to be launched from the submarine.

19. A submarine according to claim 18, wherein the lid is manually detachable.

20. A submarine according to claim 8, wherein the payload is connected to the pressure vessel and the pressure vessel is connected to the submarine.

21. A submarine according to claim 20, wherein the pressure vessel is connected to the submarine by detachable tether.

22. A submarine comprising an assembly for deploying a payload from the submarine, the assembly being releasably held on or in the submarine at a position outside the submarine's pressure hull and including a pressure vessel storing the payload in a pressurized state, the assembly being buoyant in water when the payload is stored in the pressure vessel, wherein the pressure vessel has an opening covered by a frangible releasable cover, and wherein the assembly includes a sensor for sensing whether it is at or near the water surface, and in that the pressure vessel has a cover release mechanism arranged to release the cover from the opening if the sensor senses that it is at or near the water surface.

23. A submarine comprising an assembly for deploying a payload from the submarine, which payload includes a life raft, the assembly being releasably held on or in the submarine at a position outside the submarine's pressure hull and including a pressure vessel storing the payload in a pressurized state, the assembly being buoyant in water when the payload is stored in the pressure vessel, wherein the pressure vessel has an opening covered by a releasable cover, and wherein the assembly includes a sensor for sensing whether it is at or near the water surface, and in that the pressure vessel has a cover release mechanism arranged to release the cover from the opening if the sensor senses that it is at or near the water surface.

24. A submarine according to claim 23, wherein the sensor is a pressure sensor or a sonar device arranged to sense proximity to a water surface.

25. A submarine according to claim 23, wherein the cover release mechanism comprises a ram for forcing the payload through the opening, the ram having an engagement surface for releasably engaging the payload, the payload being located between the engagement surface and the opening.

26. A submarine according to claim 23, wherein the releasable cover is held onto the pressure vessel by a retaining strap, and wherein the submarine includes a strap release mechanism connected to the retaining strap and arranged to release the strap from the releasable cover on operation of an actuator.

27. A submarine according to claim 23, wherein the assembly is located in a well which includes an opening to an environment outside the submarine, the opening being covered by a detachable lid, wherein the submarine includes a lid release mechanism connected to the lid and arranged to release the lid from the opening on operation of an actuator.

28. A submarine according to claim 23, wherein the assembly is located in a support cage, which support cage is connected to the rest of the submarine via at least one shock mount.

29. A submarine according to claim 28, wherein the assembly is held within the support cage by a retaining strap, wherein the submarine includes a strap release mechanism connected to the retaining strap and arranged to release the strap from the support cage on operation of an actuator.

30. A submarine according to claim 23 including an actuator for launching the assembly from the submarine.

31. A submarine according to claim 23, wherein the assembly is located in a well formed between the submarine's pressure hull and outer hull.

32. A submarine according to claim 31, wherein the well includes an opening to an environment outside the submarine, the opening being covered by a detachable lid, whereby detaching the lid causes the assembly to be launched from the submarine.

33. A submarine according to claim 23, wherein the payload is connected to the pressure vessel and the pressure vessel is connected to the submarine.

* * * * *